US005728179A

United States Patent [19]

Gehling et al.

[11] Patent Number: 5,728,179

[45] Date of Patent: Mar. 17, 1998

[54] COMPOSITIONS FOR REMOVING FINISHING AGENTS CONTAINING SILICONE OIL, AQUEOUS DISPERSIONS PREPARED THEREFROM AND THEIR USE

[75] Inventors: Matthias Gehling, Leichlingen; Josef Pfeiffer, Leverkusen; Rainer Tostmann, Burscheid; Nicolai Wickert, Düsseldorf, all of Germany

[73] Assignee: Bayer Aktiengesellschaft, Leverkusen, Germany

[21] Appl. No.: 560,567

[22] Filed: Nov. 20, 1995

Related U.S. Application Data

[62] Division of Ser. No. 273,677, Jul. 12, 1994, abandoned.

[30] Foreign Application Priority Data

Jul. 19, 1993 [DE] Germany ..... 43 24 152.2

[51] Int. Cl.[6] ..... D06L 1/00; D06L 1/12

[52] U.S. Cl. ..... 8/137; 8/139; 510/276; 510/499

[58] Field of Search ..... 8/137, 139; 510/276, 510/499

[56] References Cited

U.S. PATENT DOCUMENTS

| | | | |
|---|---|---|---|
| 3,985,502 | 10/1976 | Boorujy et al. | 8/137 |
| 4,654,041 | 3/1987 | Nickel | 8/137 |
| 4,931,063 | 6/1990 | Wilsberg | 8/137 |
| 4,954,270 | 9/1990 | Butterworth et al. | 8/137 |

*Primary Examiner*—Alan Diamond
*Assistant Examiner*—Cephia D. Toomer
*Attorney, Agent, or Firm*—Sprung Kramer Schaefer & Briscoe

[57] ABSTRACT

A process for removing finishing agents containing silicone oil from textile substrates in an aqueous medium free of halogenated hydrocarbons, wherein the removing agent is a composition containing, as an essential ingredient, a surfactant carrying cationic groups on the surfactant framework structure, and which may also contain acids, non-ionic surfactants, water-soluble non-ionic polymers and solvents (free of halogenated hydrocarbons).

2 Claims, No Drawings

COMPOSITIONS FOR REMOVING FINISHING AGENTS CONTAINING SILICONE OIL, AQUEOUS DISPERSIONS PREPARED THEREFROM AND THEIR USE

This application is a divisional, of application Ser. No. 08/273,677, filed Jul. 12, 1994.

BACKGROUND OF THE INVENTION

The present invention relates to a surfactant system enabling finishing agents containing silicone oil to be removed from textile substrates in an aqueous medium free of halogenated hydrocarbons.

In current practice, the silicone oils are removed during the so-called "drycleaning", which consists in dissolving off the oil from the textile substrate by means of organic solvents usually containing halogenated hydrocarbons.

A drastic reduction in the use of halogenated hydrocarbons is increasingly requested and implemented nationally and internationally for ecological reasons.

This is why there is a search for alternative cleaning methods which are capable of replacing drycleaning. This is also true in particular of blended fiber substrates containing an elastane fiber portion. The finishing agent for the elastane fiber typically consists to a large proportion of polyalkylsiloxane oils which previously could only be removed sufficiently by drycleaning. If the attempt is made to effect cleaning in an aqueous medium using anionic or anionic/non-ionic or else purely non-ionic surfactant systems such as those which constitute the prior art in the pretreatment of textiles, only an insufficient removal of silicone oil is achieved. This leads to silicone spots on the treated textile. The silicone oil left on the textile shows itself in the subsequent dyeing process by unlevelness and spottiness of the dyeing (cf. Textilveredlung 5, No. 2 (1970), 122 ff. and Chemiefasern—Text. Ind. 17, No. 1(1967), 47–51).

SUMMARY OF THE INVENTION

It has now been found that silicone finishing agents can be effectively dissolved off and specky deposits of silicone oil are not formed if the textiles are washed with preparations of the composition listed below.

The present invention, then, relates to compositions containing (1.)1 to 99% by weight of a surfactant carrying cationic groups derived from amino nitrogen on the framework structure of the surfactant, (2.)0 to 20% by weight of organic or inorganic acids, (3.)0 to 60% by weight of non-ionic surfactants, (4.)0 to 60% by weight of water-soluble non-ionic polymers, and (5.)0 to 70% by weight of organic solvents with the exception of halogenated hydrocarbons, one or more of components (2) to (5) being different from 0 and components (2) to (5) together representing at least 1% by weight.

DETAILED DESCRIPTION OF THE INVENTION

Components (1) of the composition according to the invention include those surfactants which, in addition to a hydrophobic fatty radical, contain a hydrophilic cationic group which is either permanently present or is formed as a function of the pH. Examples of further hydrophilic groups which may be present are hydroxyl, carboxyl, sulphate or sulphonate groups (cf. Stache, Tensidtaschenbuch, 2nd edition, Vienna, Hahset, 1981 and Lindner, Tenside-Textilhilfsmittel-Waschrohstoffe, Volume III, Stuttgart, wissenschaftliche Verlagsgesellschaft mbH, 1971). Compounds of the type described can be found in the classes:

1*a*) of protonated, primary, secondary or tertiary or quaternized alkylamines or alkyl- or acyl-polyamines of the formula

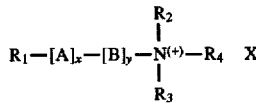

$$R_1-[A]_x-[B]_y-N^{(+)}(R_2)(R_3)-R_4 \quad X^{(-)} \quad (),$$

where

| | |
|---|---|
| $R_1$ | denotes $C_8$-$C_{30}$-alkyl (saturated or unsaturated) |
| $R_2$, $R_3$, $R_4$ | independently of one another, denote $R_1$, H, $C_1$-$C_4$-alkyl, benzyl $(C_2H_4O)_nH$ $(C_3H_6O\text{-})_nH$, n being 1–20 |
| A | denotes CONH-$C_1$-$C_4$-alkylene, x being 0, 1 |
| B | denotes $NR_5$-$C_1$-$C_4$-alkylene, 0-$C_1$-$C_4$-alkylene, y being 0, 1, 2, 3, 4 |
| $R_5$ | denotes H, $C_1$-$C_4$-alkyl, benzyl, $(C_2H_4O\text{-})_nH$, $(C_3H_6O\text{-})_nH$, n being 1–5 |
| $X^{\ominus}$ | denotes the anion of an inorganic or organic acid, for example lactic, citric, acetic, formic, oxalic acid, hydrohalic acid, oxo acids of sulphur or phosphorus in various oxidation states, of methylsulphuric acid ($CH_3SO_4$-), and the like, |

1*b*) of tertiary alkylamine oxides in the protonated (IIa) or non-protonated (IIb) form in accordance with the formulae

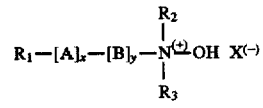

$$R_1-[A]_x-[B]_y-N^{(+)}(R_2)(R_3)-OH \quad X^{(-)} \quad \text{or} \tag{IIa}$$

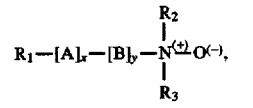

$$R_1-[A]_x-[B]_y-N^{(+)}(R_2)(R_3)-O^{(-)}, \tag{IIb}$$

in which $R_1$, $R_2$, $R_3$, A, B, X, x and y have the abovementioned meaning.

1*c*) of amphoteric surfactants of the ampholyte, betaine or sulphobetaine type in protonated (IIIa) or non-protonated (IIIb) form in accordance with the formulae

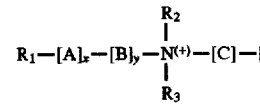

$$R_1-[A]_x-[B]_y-N^{(+)}(R_2)(R_3)-[C]-[D]H \quad X^{(-)} \quad \text{bzw.} \tag{IIIa}$$

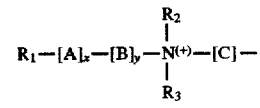

$$R_1-[A]_x-[B]_y-N^{(+)}(R_2)(R_3)-[C]-[D]^{(-)}, \tag{IIIb}$$

in which $R_1$, $R_2$, $R_3$, A, B, X, x and y have the abovementioned meaning,

C represents $C_1$–$C_4$-alkylene or $C_1$–$C_4$-hydroxyalkylene, and

D denotes the anionic group —COO or —$SO_3$.

1*d*) of protonated imidazole compounds (IVa) or quaternary imidazolinium salts thereof (IVb) in accordance with the formulae

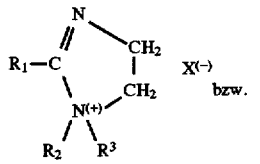

(IVa)

bzw.

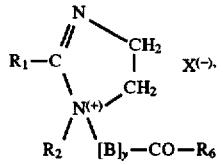

(IVb)

in which $R_1$, B, X and y have the abovementioned meaning, $R_2$ and $R_3$, independently of one another, denote hydrogen, $C_1$–$C_4$-alkyl, benzyl or $C_1$–$C_4$-hydroxyalkyl, and $R_6$, independently of $R_1$, has the range of meanings of $R_1$.

The cation activity of the surfactants of the formulae (I) to (IV) is pH-dependent. It can be increased by addition of acid, i.e., the component (2) of the composition according to the invention. The composition according to the invention is in this case preferably such that the pH in the resulting application liquor is 2–6 particularly preferably 3–5. Basically, the pH during the application of the compositions according to the invention may be 0–14. If application is to take place at a neutral or basic pH, it is sensible not to add component (2).

The pH adjustment in the range 0–14 can be effected by addition of any inorganic or organic base or acid to the application liquor.

Examples of common acids for the compositions according to the invention (component (2)) include: formic acid, acetic acid, lactic acid, citric acid, tartaric acid, oxalic acid, malic acid, oxo acids of sulphur and phosphorus (in various oxidation states), hydrochloric acid, and the like. Such and other suitable acids for this purpose are known to one skilled in the art.

Advantageously, the compositions according to the invention contain, as component (3), non-ionic surfactants. These include the well known adduct of ethylene oxide or propylene oxide with primary or secondary alcohols, alkylphenols or saturated or unsaturated fatty acids or fatty amides (cf. Stache, Tensidtaschenbuch, 2nd edition, Vienna, Hanser, 1981). 3) Alkyl- or arylpolyalkylene oxides of the formula $$R_7\text{-}[E]\text{-}(A\text{—}O)_nH \qquad (V),$$

where $R_7$ denotes straight-chain or branched, saturated or unsaturated $C_8$–$C_{30}$-alkyl or straight-chain or branched $C_4$–$C_{16}$-alkylphenyl, A denotes $C_1$–$C_4$-alkylene E denotes COO, CONH, O n denotes 2–70.

$R_7$ is preferably $C_8$–$C_{30}$-alkyl, particularly preferably $C_{10}$–$C_{18}$-alkyl.

Furthermore, the compositions according to the invention contain water-soluble polymers as component (4). These are high-molecular-weight, chemically modified or unmodified natural products or synthetic polymers (cf. Chwalla/ Anger, Handbuch der Textilhilfsmittel, p. 937 ff., Verlag Chemie, Weinheim 1977 and Ullmanns Encycl. der techn. Chemie, 4th edition, Vol. 24, 102 ff., Verlag Chemie, Weinheim, 1983).

In addition to anionic and cationic water-soluble polymers, non-ionic types are known which here are very particularly preferably used.

Examples of non-ionic water-soluble polymers usable for stabilizing the washing liquor are:

a) polyvinyl alcohol and other hydrolysis products of vinyl acetate copolymers with olefins, vinyl ether, acrylamide, acrylonitrile, and the like b) polyacrylamide, polymethacrylamide and acrylamide and methacrylamide copolymers with acrylic esters, vinyl acetate, and the like c) polyvinylpyrrolidone or copolymers thereof with vinyl acetate, vinyl alcohol, and the like d) etherified polymer carbohydrates, such as methylcellulose, and the like e) dextrins.

Individual products which are used here particularly preferably are the following (cf. Ullmanns Encycl. der techn. Chemie, 4th edition, Vol. 19, 367–387, Verlag Chemie, Weinheim, 1983 and Lindner, Textilhilfsmittel und Waschrohstoffe, p. 87, wissenschaftl. Verlagsgesellschaft, Stuttgart 1954):

a) polyvinyl alcohol of the formula

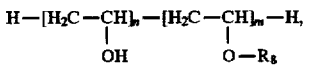

(VI)

where $R_8$ denotes $COCH_3$ n:m is 85–90:15–10, preferably 88–89:12–11. The product is prepared by hydrolysis of polyvinyl acetate and thus formally must be regarded as a random copolymer.

n+m is 500–2500.

Polyvinyl alcohol can be purchased from numerous manufacturers under various tradenames (Vinarol® or Mowiol®—Hoechst; Polyviol®—Wacker Chemie GmbH and others).

b) Polyvinylpyrrolidone of the formula (cf. DT 2,607,656 A1)

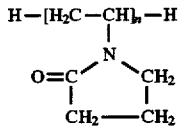

(VII)

n is 10–9000 c) Polyvinylpyrrolidone copolymers with vinyl acetate of the formula (cf. DT 2,607,656 A1, Example 9)

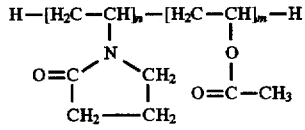

(VIII)

n+m is 10–9000 n:m is 99–70:30–1 d) Etherified polymer carbohydrates, such as methylcellulose or methylhydroxyethylcellulose, such as disclosed in DT 2,613,790 and described by Greminger in J. Am. Oil Chemists' Society 55 (1978), 122 ff., of the formula

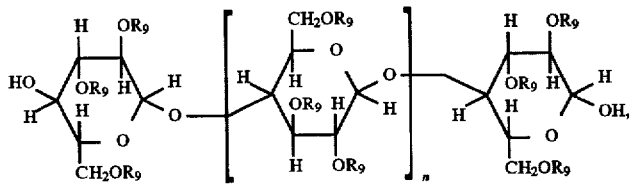

(IX)

where $R_9$ denotes $C_1$–$C_4$-alkyl; $C_1$–$C_4$-hydroxyalkyl, -H degree of substitution >1 and <2.7 per glucose unit n is 100–1000.

The basic structure of the etherified polymer carbohydrates provided according to the invention is that of the formula (IX), in which n represents an integer from about 100 to 10000, preferably 100 to 200, and $R_9$ represents hydrogen, alkyl, hydroxyalkyl or mixed alkyl and hydroxyalkyl. Suitable alkyl radicals are the methyl, ethyl, propyl and butyl radical, preference being given to the methyl radical. Preferred hydroxyalkyl radicals are the hydroxymethyl, hydroxyethyl, hydroxypropyl and hydroxybutyl radical, of which preference is given to the hydroxybutyl radical. If all hydroxyl groups of the glucose unit are substituted by alkyl or hydroxyalkyl groups, this is referred to as a degree of substitution of 3.

The preferred water-soluble polymer is polyvinyl alcohol.

The solvents free of halogenated hydrocarbons, i.e., component (5) of the composition according to the invention, are designed in particular for establishing and maintaining the desired viscosity of the formulations of components (1) to (4). In those cases where the formulations exhibit the dissolving power for the silicone oil to be removed, a synergistic effect in silicone removal is obtained. Examples of suitable solvents (5), which are also used in a mixture, are ethanol, isopropanol, 1-methoxypropanol, diethylene glycol, tripropylene glycol and others known to one skilled in the art.

Accordingly, the compositions according to the invention always contain a cationic surfactant (1) in combination with at least one of the components (2), (3), (4) and (5). Preferably, in addition to (1), a portion of the non-ionic surfactant (3), water-soluble non-ionic polymer (4) or both is present, particularly preferably only one of (3) and (4) is present. Preference is given to compositions containing 3–80% by weight of (1) and 1–60% by weight of (3) and/or 1–60% by weight of (4), 0–20% by weight of (2) and 0–70% by weight of (5), particular preference being given to those containing the amounts given of (1), (4), (2) and (5).

In such a form, the compositions according to the invention can be utilized in commercial form. They are applied in the form of an aqueous liquor obtained by dilution of the commercial form with water. Such a dilution can in general be obtained more easily if the compositions according to the invention additionally contain solvents (5).

Accordingly, further preferred compositions are those containing 3–77% by weight of (1) and 1–60% by weight of (3) and/or 1–60% by weight of (4), 0–20% by weight of (2) and 3–70% by weight of (5); particularly preferred compositions contain 3–77% by weight of (1), 1–60% by weight of (4), 0–20% by weight of (2) and 3–70% by weight of (5).

For application in the acid pH range, it is furthermore advantageous to standardize the commercial form by addition of the acid (2) which is necessary anyway for adjusting the pH during the application. Accordingly, the amount of (2) is preferably 2–8% by weight of the total composition.

The compositions according to the invention can be converted into aqueous dispersions which, owing to their additional water content, can be more easily dissolved in the eventually used washing liquor (containing 0.1–30 g of dispersion/l of washing liquor). Such aqueous dispersions cover the range of high concentrations, for example as shipping form to be transported, to medium concentrations for metered addition to the washing liquor during storage for industrial practice, down to low concentrations of the actual washing liquors. Accordingly, these aqueous dispersions are also provided by the invention. Therefore, their water content is in general 1–99.7% by weight, relative to the total weight of the aqueous dispersions prepared from the compositions according to the invention. In addition, 0–70% by weight of (5) are present.

As shipping form or dosage form, such dispersions contain 3–90% by weight of water. Including the amount of (5), the aqueous dispersions are preferably characterized by a total water and (5) content of 20–90% by weight.

When preparing the compositions described above, the components can usually be mixed with one another in any desired order. The different dissolving behaviour in the heat and the cold of the water-soluble polymers, if used, must be taken into account. In the individual case, details of the dissolving behaviour of these products are available from the manufacturers of such products or can be obtained from the literature.

The relative amounts of components (1) to (5) can be selected as a function of the desired washing effects or product viscosity.

The use of the claimed compositions and the aqueous dispersions preparable therefrom when applied for removing finishing agents containing silicone oil from textile substrates, in particular from elastane fiber blend articles in aqueous medium is a further aspect of the invention and not bound to a specific industrial washing process. A batch method gives the same results as a continuous method. Methods in which the goods, in order to avoid mechanically produced fiber breaks, are treated in an open-width low-tension strand of guiding using minimal mechanical stress have proven to be particularly advantageous.

Cationic surfactants are known to exhaust onto textile substrates of the type mentioned. Therefore, they would have been expected to be unsuitable for washing processes. Surprisingly, this is not the case in the removal of finishing agents containing silicone oil.

EXAMPLE 1

Dry-cleaned goods (for comparison)

Cleaning was performed on a finished polyamide-elastane blend fabric containing silicone oil, which had been processed as a warp-knitted fabric. The material was cleaned with perchloroethylene under practical conditions in an industrially used dry-cleaning washing machine. After dry-cleaning, 10 g of the material were removed as a sample for extraction and extracted with petroleum ether in accordance with DIN 54 278. The unset raw material (before a heat setting), which was extracted analogously, served as comparison standard.

The finishing agent add-on (raw material) or the residual finishing agent add-on (dry-cleaned material) which can be determined via the petroleum ether extracts does not permit a reliable statement on the effectiveness of silicone oil removal to be made.

This is why the silicone oil content of the petroleum ether extract was determined quantitatively. This was done accurately by means of a quantitative $^1$H-NMR method.

| Material | Petroleum ether extract (%) | Silicone oil in the extract (%) | Silicone oil on the material (%) | Silicone oil removed (%) |
|---|---|---|---|---|
| raw material | 2.03 | 40.20 | 0.816 | — |
| dry-cleaned | 0.13 | 11.70 | 0.015 | 98.2 |

EXAMPLE 2:

(according to the invention)

The silicone oil dissolving power of the compositions according to the invention was demonstrated in washing of knitted stockings made of 100% elastane fiber. Determination of the petroleum ether extract from the washed material compared with that from the raw material made it possible to make a statement on the washing effect.

The washing tests were carried out on two elastane fiber types finished with different silicone oils. In all tests, the liquor ratio was 10:1. Each material was washed at 80° C. for 30 minutes in a washing machine of the AHIBA Polymat type (10 g/1 of DAS) and then rinsed twice at 80° C. with water.

Prior to the wash, the washing liquors were brought to a pH of 4 to 5 with glacial acetic acid.

Material

100% of elastane fiber; finished with two commercially available silicone oils; knitted to give a stocking.

| | (%) Finishing agent removed | |
|---|---|---|
| Example[1)] | Finishing agent 1 (%) | Finishing agent 2 (%) |
| 2a | 60 | 49 |
| 2b | 80 | 50 |
| 2c | 86 | 58 |
| 2d | 90 | 56 |
| 2e | 89 | 54 |
| 2f | 90 | 50 |
| 2g | 78 | 44 |
| 2h | 76 | 47 |
| 2i | 76 | 49 |
| 2j | — | 42 |
| 2k | — | 31 |
| 21 | — | 31 |
| 2m | — | 66 |

Description of the compositions

| | | |
|---|---|---|
| Example 2a: | 30% | of the surfactant of the formula (IIIb)<br>$R_1 = C_{13/14}$-alkyl; saturated<br>x; y = 0<br>$R_2, R_3 = CH_3$<br>$C = CH_2$<br>D = —COO |
| | 70% | of water |
| Example 2b: | 10% | of the surfactant of the formula (I)<br>$R_1 = C_{18}$-alkyl; saturated<br>$R_2, R_3, R_4 = CH_3$<br>$X^{\ominus} = CH_3SO_4^{\ominus}$ |
| | 90% | of water |
| Example 2c: | 40% | of the surfactant of the formula (IIIb)<br>$R_1 = C_{16,18}$-alkyl; saturated<br>x; y = 0<br>$R_2, R_3 = C_2H_4OH$<br>$C = CH_2$<br>D = —COO |
| | 60% | of water |
| Example 2d: | 25% | of the surfactant of the formula (IIb)<br>$R_1 = C_{18}$-alkyl; saturated<br>x, y = 0<br>$R_2$, R3 = $C_2H_4OH$ |
| | 12.5% | of diethylene glycol |
| | 62.5% | of water |
| Example 2e: | 25% | of the surfactant of the formula (IIb)<br>$R_1 = C_{18}$-alkyl; saturated<br>x, y = 0<br>$R_2, R_3 = C_2H_4OH$ |
| | 25% | of diethylene glycol |
| | 50% | of water |
| Example 2f: | 25% | of the surfactant of the formula (IIb)<br>$R_1 = C_{18}$-alkyl; saturated<br>x, y = 0<br>$R_2, R_3 = C_2H_4OH$ |
| | 50% | of diethylene glycol |
| | 25% | of water |
| Example 2g: | 20% | of the surfactant of the formula (IIb)<br>$R_1 = C_{13/15}$-alkyl; saturated<br>x, y = 0<br>$R_2, R_3 = C_2H_4OH$ |
| | 17% | of tripropylene glycol |
| | 63% | of water |
| Example 2h: | 20% | of the surfactant of the formula (IIb)<br>$R_1 = C_{13/15}$-alkyl; saturated<br>x, y = 0<br>$R_2, R_3 = C_2H_4OH$ |
| | 34% | of tripropylene glycol |
| | 46% | of water |
| Example 2i: | 10% | of the surfactant of the formula (IIb)<br>$R_1 = C_{13/15}$-alkyl; saturated<br>x, y = 0<br>$R_2, R_3 = C_2H_4OH$ |
| | 34% | of tripropylene glycol |
| | 56% | of water |
| Example 2j: | 50% | of the surfactant of the formula (I)<br>$R_1 = C_{16/18}$-alkyl; unsaturated; oleyl<br>x, y = 0<br>$R_2, R_3, R_4 = CH_2$<br>$X^{\ominus} = Cl^{\ominus}$ |
| | 36% | of isopropanol |
| | 14% | of water |
| Example 2k: | 50% | of the surfactant of the formula (I)<br>$R_1 = C_{16/18}$-alkyl, saturated<br>x, y = 0<br>$R_2, R_3, R_4 = CH_3$<br>$X^{\ominus} = Cl^{\ominus}$ |
| | 37% | of isopropanol |
| | 13% | of water |
| Example 2l: | 76% | of the surfactant of the formula (I)<br>$R_1 = C_{16/18}$-alkyl; unsaturated; oleyl<br>x, y = 0<br>$R_2, R_3 = C_2H_4OH$<br>$R_4 = CH_3$<br>$X^{\ominus} = Cl^{\ominus}$ |
| | 21% | of isopropanol |
| | 3% | of water |
| Example 2m: | 40% | of the surfactant of the formula (IIIb)<br>$R_1 = C_{12/18}$-alkyl; saturated; coconut alkyl<br>x, y = 0<br>$R_2, R_3 = H$<br>$C = CH(CH_3)-CH_2$ |

-continued

| | |
|---|---|
| | D = —COO |
| 16% | of isopropanol |
| 44% | of water |

EXAMPLE 3

(Comparison of the compositions according to the invention with surfactant systems which in the area of aqueous cleaning constitute the prior art)

About 10 g each of a commercially finished 80:20 polyamide/polyurethane blend fabric containing silicone oil were washed at 80° C. for 30 minutes (liquor ratio 10:1; 1 g/1 of DAS) with a composition according to the invention, with a non-ionic, with a non-ionic/anionic and with an anionic detergent in an AHIBA Polymat. After being rinsed twice at 80° C., the material was extracted with petroleum ether, and silicone removal was determined by quantitative $^1$H-NMR analysis of silicone oil in the extract. The unset raw material served as reference material.

| Example[1)] | Petroleum ether extract (%) | Silicone oil in the extract (%) | Silicone oil on the material (%) | Silicone oil removed (%) |
|---|---|---|---|---|
| 3a | 1.25 | 4.2 | 0.053 | 93 |
| 3b | 1.89 | 5.5 | 0.104 | 63 |
| 3c | 1.50 | 16.4 | 0.246 | 69 |
| 3d | 1.39 | 17.2 | 0.239 | 70 |
| raw material | 2.00 | 40.2 | 0.804 | — |

[1)]Description of the compositions
Example 3a (according to the invention):
50% of the surfactant of the formula (IIb):
$R_1 = C_{18}$-alkyl; saturated
x, y = 0
$R_2, R_3 = C_2H_4OH$
25% of diethylene glycol
25% of water
Example 3b (non-ionic)
90% of isotridecyl alcohol + 6EO
10% of water
Example 3c (non-ionic/anionic)
35% of $C_{15}$-alkylsulphonic acid as sodium salt
20% of decanol + 3EO
45% of water
Example 3d (anionic):
40% of $C_{15}$-alkylenesulphonic acid as sodium salt
60% of water

EXAMPLE 4

Example 3 was repeated, washing the material with compositions according to the invention at a pH of 4–4.5. The washing liquors obtained had the compositions listed below[1)]. They are given in g/l, which is common practice in application. The composition in per cent can be derived from these data. The pH was adjusted with glacial acetic acid.

| Example[1)] | Petroleum ether extract (%) | Silicone oil in the extract (%) | Silicone oil on the material (%) | Silicone oil removed (%) |
|---|---|---|---|---|
| 4a | 1.04 | 6.1 | 0.063 | 92 |
| 4b | 1.07 | 6.8 | 0.073 | 91 |
| 4c | 1.10 | 8.0 | 0.088 | 89 |
| 4d | 1.13 | 9.2 | 0.104 | 87 |
| 4e | 1.04 | 4.7 | 0.049 | 94 |
| 4f | 1.07 | 6.3 | 0.067 | 92 |
| raw material | 2.00 | 40.2 | 0.804 | — |

[1)]Description of the washing liquor composition
Example 4a:
0.36 g/l of the surfactant of the formula (IIb):
$R_1 = C_{18}$-alkyl
saturated
x, y = 0
$R_2, R_3 = C_2H_4OH$
5.00 g/l of the polyvinyl alcohol of the formula (VI)
0.18 g/l of diethylene glycol
0.14 g/l of isopropanol
Example 4b:
0.18 g/l of the surfactant of the formula (IIb):
$R_1 = C_{18}$-alkyl;
saturated
x, y = 0
$R_2, R_3 = C_2H_4OH$
5.00 g/l of the polyvinyl alcohol of the formula (VI)
0.09 g/l of diethylene glycol
0.07 g/l of isopropanol
Example 4c:
0.18 g/l of the surfactant of the formula (IIb):
$R_1 = C_{18}$-alkyl
saturated
x, y = 0
$R_2, R_3 = C_2H_4OH$
0.22 g/l of the surfactant of the formula (V);
R = alkyl ($C_{12-18}$); n = 3
0.09 g/l of diethylene glycol
0.07 g/l of isopropanol
Example 4d:
0.36 g/l of the surfactant of the formula (IIb):
$R_1 = C_{18}$-alkyl,
saturated
x, y = 0
$R_2, R_3 = C_2H_4OH$
0.22 g/l of the surfactant of the formula (V);
R = alkyl ($C_{12-18}$); n = 3
0.18 g/l of diethylene glycol
0.14 g/l of isopropanol
Example 4e:
1.80 g/l of the surfactant of the formula (IIb):
$R_1 = C_{18}$-alkyl;
saturated
x, y = 0
$R_2, R_3 = C_2H_4OH$
5.00 g/l of polyvinyl alcohol of the formula (VI)
0.9 g/l of diethylene glycol
0.7 g/l of isopropanol
Example 4f:
3.60 g/l of the surfactant of the formula (IIb):
$R_1 = C_{18}$-alkyl;
saturated
x, y = 0
$R_2, R_3 = C_2H_4OH$
5.00 g/l of polyvinyl alcohol of the formula (VI)
1.80 g/l of diethylene glycol
1.40 g/l of isopropanol Since the density of the washing liquors differs only slightly from that of water, the g/l data customary in practice can be easily converted into % by weight.

What is claimed is:

1. A process for removing finishing agents containing silicone oil from textile substrates by treatment of the textile substrates with a removing agent comprising relative to its total weight, (1) 1–99% by weight of a surfactant of the formulae

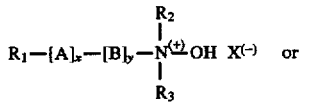

(IIa)

or

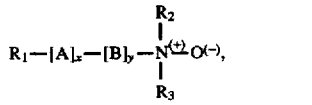

(IIb)

where $R_1$ denotes $C_8$–$C_{30}$-alkyl or $C_8$–$C_{30}$ alkenyl, $R_2$ and $R_3$ independently of one another, denotes $R_1$, H, $C_1$–$C_4$-alkyl, benzyl, $(C_2H_4O)_nH$, $(C_3H_6O—)_nH$, n being 1–20, A denotes CONH—$C_1$–$C_4$-alkylene, x being 0 or 1, B denotes $NR_5$—$C_1$–$C_4$-alkylene, O—$C_1$–$C_4$-alkylene, y being 0, 1, 2, 3, or 4, $R_5$ denotes H, $C_1$–$C_4$-alkyl, benzyl, $(C_2H_4O—)_nH$, $(C_3H_6O—)_nH$, n being 1–5, $X^{\ominus}$ denotes the anion of an inorganic or organic acid, (2) 0–20% by weight of organic or inorganic acids, (3) 0–60% by weight of non-ionic surfactants, (4) 0–60% by weight of water-soluble non-ionic polymers, and (5) 0–70% by weight of organic solvents with the exception of halogenated hydrocarbons, one or more of components (2) to (5) being different from 0 and components (2) to (5) representing at least 1% by weight or an aqueous dispersion preparable therefrom.

2. The process of claim 1, wherein said organic or inorganic acids are selected from the group consisting of formic acid, acetic acid, lactic acid, citric acid, tartaric acid, oxalic acid, malic acid, oxo acid of sulphur and phosphorus and hydrochloric acid.

* * * * *